US011308926B2

(12) United States Patent
Shi et al.

(10) Patent No.: US 11,308,926 B2
(45) Date of Patent: Apr. 19, 2022

(54) METHOD AND SYSTEM FOR COMPOSING MUSIC WITH CHORD ACCOMPANIMENT

(71) Applicants: Zheng Shi, Beijing (CN); Peiyuan Yang, Beijing (CN)

(72) Inventors: Zheng Shi, Beijing (CN); Peiyuan Yang, Beijing (CN)

( * ) Notice: Subject to any disclaimer, the term of this patent is extended or adjusted under 35 U.S.C. 154(b) by 181 days.

(21) Appl. No.: 16/869,592

(22) Filed: May 8, 2020

(65) Prior Publication Data

US 2021/0043175 A1 Feb. 11, 2021

Related U.S. Application Data

(60) Provisional application No. 62/884,679, filed on Aug. 9, 2019.

(51) Int. Cl.
*G10H 1/38* (2006.01)
*G10H 1/00* (2006.01)

(52) U.S. Cl.
CPC ..... *G10H 1/0066* (2013.01); *G10H 1/38* (2013.01); *G10H 2210/576* (2013.01)

(58) Field of Classification Search
CPC ..... G10H 1/0025; G10H 1/38; G10H 1/0066; G10H 1/0008; G10H 2210/111; G10H 2210/576; G10H 2240/056; G10H 1/0058; G10H 2210/145; G10H 2210/105; G10H 2240/311; G10H 2240/165; G10H 2210/101; G10H 2210/571; G10H 2210/565; G10H 2220/061; G10H 1/18
See application file for complete search history.

(56) References Cited

U.S. PATENT DOCUMENTS 5,712,436 A * 1/1998 Sakama ..... G10H 1/36 84/610
6,057,503 A * 5/2000 Shinsky ..... G10H 1/0025 84/613
6,093,881 A * 7/2000 Fay ..... G10H 1/0025 84/613
6,448,486 B1 * 9/2002 Shinsky ..... G10H 1/0025 84/613
2003/0188627 A1 * 10/2003 Longo ..... G10H 1/0066 84/627

(Continued)

FOREIGN PATENT DOCUMENTS

WO WO-2008113120 A1 * 9/2008 ..... G10H 1/0008
WO WO-2017058844 A1 * 4/2017 ..... G10H 1/00

*Primary Examiner* — Marlon T Fletcher

(57) ABSTRACT

The present invention provides method and system for composing music with chord accompaniment. One or more keys on a first keyboard are selected by end-users to generate a chord progression, and a computer generates a chord progression MIDI file, and associates the file with a first physical card that is embedded with a unique machine-readable ID (UID). After the UID of the first physical card is subsequently recognized, the chord progression MIDI file is retrieved and played. While the chord progression MIDI file is played, certain keys on a second keyboard are highlighted, and each of the highlighted keys on a second keyboard represents a music note that is in harmony with a particular chord in the chord progression while the particular chord is being played, and one or more of the highlighted keys on the second keyboard are selected by the end-user to compose a melody.

8 Claims, 7 Drawing Sheets

(56) References Cited

U.S. PATENT DOCUMENTS

| | | | | |
|---|---|---|---|---|
| 2007/0119292 | A1* | 5/2007 | Nakamura | G10H 1/361 84/610 |
| 2008/0314228 | A1* | 12/2008 | Dreyfuss | G10H 1/0008 84/477 R |
| 2013/0305906 | A1* | 11/2013 | Kinter | G10H 1/386 84/613 |
| 2021/0043175 | A1* | 2/2021 | Shi | G10H 1/38 |

* cited by examiner

METHOD AND SYSTEM FOR COMPOSING MUSIC WITH CHORD ACCOMPANIMENT

CROSS-REFERENCE TO RELATED APPLICATION

This application claims priority to U.S. Provisional Application No. 62/884,679 entitled "System and Method for Composing Music with Chord Accompaniment", filed on Aug. 9, 2019, which is incorporated by reference herein.

TECHNICAL FIELD

The present invention and its embodiments relate to the field of music application on electronic devices, and in particular, method and system for composing music with chord accompaniment.

BACKGROUND

Music is the one of the most magnificent creations of the human race. Music is expressed in complex forms, syntaxes, colors and articulations that are rooted both in the human biology and elegant mathematics.

Learning, composing, accessing and playing music are among the most fundamental human activities. Other than being an art form practiced by professional musicians and enjoyed by almost everyone else in the world, numerous studies have shown that music is greatly beneficial to the cognitive development of children.

Because of the advancement in technology over the last century, there is now little barrier for accessing and enjoying music. Music is performed in concert halls and recording studios; performance is recorded, stored and disseminated via a great variety of formats and channels. Consequently, almost any music is available at any time in any place to anyone with reasonable access.

Nonetheless, despite such technological advancement over the last century, there is still plenty of improvement potential for assisting learning and composing music by both professionals and novices, by the very senior and the very young, including as young as 2 to 3 years of age when the children have already developed an interest in music.

Three major barriers to learning and composing music have been observed, as outlined in our previous inventions:

1. Skill required. The most commonly practiced format of learning music is the learning of a particular musical instrument. For example, parents often engage piano teachers to teach their children piano, while musicians play the piano to compose music. Needless to say, it takes years of vigorous practice to become good at playing piano at the amateur level, a process quite often forced upon children by their parents which costs time, money and possibly the children's very interest in music. It takes tremendous practice and sacrifice to become a pianist.

2. Tools available. Being good at one musical instrument does not readily give one the ability to compose a music piece, with the full range of tunes and rhythms. For example, being good at piano does not readily enable someone to compose music with the drum, the trumpet, or the violin. The popular software program GarageBand by Apple Inc. allows the user to create music with elements of percussion, wind and string instruments. However, the functionality in GarageBand relating to the construction of original music is still highly complex.

3. Music syntax. The syntax of music is highly complex. Terms such as chord, diatonic chord, accidental, major and minor and their many types, variations, equivalency and inversions are simply beyond the grasp of most children and the vast majority of the people who are not professional musicians and have not learned the intricacies of music theories. While anyone can "create music" by singing into a microphone or hitting a few keys on the electronic piano, without the precise language of music syntax, such rudimentary recording cannot be precisely described, nor can it be dissected, analyzed, or further improved upon.

It is particularly difficult for entry-level music learners to harmonize a melody with a set of chords, which is a skill that takes time to develop. We therefore see the necessity to create a system that greatly reduces the skills required for harmonizing melodies with chords, that makes composing music more easily doable, and that allows harmonized melodies and chords to be created based more on one's appreciation and imagination in music and less on one's mastery of the music syntax or skills with respect to a particular musical instrument.

SUMMARY OF THE INVENTION

The present invention resolves limitations of prior art, some of which are highlighted in the background section, by providing method and system for composing music with chord accompaniment.

In accordance with an embodiment of the present invention, the method for composing music with chord accompaniment includes the following steps:

selecting, by an end-user, one or more keys on a first keyboard operatively linked to a computer to generate a chord progression, wherein each of the keys represents a chord;

generating, by the computer, a chord progression MIDI file that represents the chord progression;

associating, by the end-user, the chord progression MIDI file with a first physical card among a plurality of physical cards, each embedded with a unique machine-readable ID (UID);

reading the UID of the first physical card, retrieving the chord progression MIDI file, and playing the chord progression MIDI file as an audio output, by the computer;

highlighting, by the computer, certain keys on a second keyboard operatively linked to the computer, concurrent to the chord progression MIDI file being played by the computer, wherein each of the highlighted keys on the second keyboard represents a music note that is in harmony with a particular chord in the chord progression while the particular chord is being played;

selecting, by the end user, one or more of the highlighted keys on the second keyboard to compose a melody.

For the purpose of this patent application, a physical card is a disc like structure that has a unique machine-readable identification chip, for example, an RFID tag, placed inside it. A physical card might be a chord card, a melody card, or a music piece card, etc.

In accordance with another embodiment of the present invention, the method further includes:

generating, by the computer, a melody MIDI file that represents the melody created by the end-user; and associating, by the end-user, the melody MIDI file with a second physical card.

In accordance with an embodiment of the present invention, the method further includes:

placing, by the end-user, the first and the second physical cards on the reader;

retrieving, by the computer, the chord progression MIDI file associated with the first physical card and the melody MIDI file associated with the second physical cards;

combining the two MIDI files into a single MIDI file.

In accordance with another embodiment of the present invention, the method further includes:

placing, by the end-user, the first and the second physical cards on the reader;

retrieving, by the computer, the chord progression MIDI file associated with the first physical card and the melody MIDI file associated with the second physical cards;

playing, by the computer, the chord progression and the melody as a single music piece.

In accordance with another embodiment of the present invention, a system for composing music with chord accompaniment includes a first keyboard, a second keyboard, and a reader, all of which are operatively linked to a computer, and a first physical card among a plurality of physical cards. Each of the physical cards is embedded with a unique machine-readable ID (UID). Once an end-user selects one or more keys on the first keyboard to generate a chord progression, the computer is configured to generate a chord progression MIDI file that represents the chord progression. And the computer is further configured to associate the chord progression MIDI file with UID of a first physical card once the end-user places the first physical card on the reader. Subsequently, the computer is configured to retrieve the chord progression MIDI file associated with the first physical card, and play the chord progression MIDI file as an audio output. Concurrent to the chord progression MIDI file being played, the computer is configured to highlight certain keys on the second keyboard, with each of the highlighted keys on the second keyboard representing a music note that is in harmony with a particular chord in the chord progression while the particular chord is being played. The end-user further selects one or more of the highlighted keys on the second keyboard to compose a melody.

BRIEF DESCRIPTION OF THE DRAWINGS

To better illustrate the technical features of the embodiments of the present invention, various embodiments of the present invention will be briefly described in conjunction with the accompanying drawings. It should be obvious that the drawings are only for exemplary embodiments of the present invention, and that a person of ordinary skill in the art may derive additional drawings without deviating from the principles of the present invention.

DETAILED DESCRIPTION OF THE INVENTION

Reference will now be made in detail to various embodiments of the invention illustrated in the accompanying drawings. While the invention will be described in conjunction with the embodiments, it will be understood that this is not intended to limit the scope of the invention to these specific embodiments. The invention is intended to cover all alternatives, modifications and equivalents within the spirit and scope of invention, which is defined by the apprehended claims.

Furthermore, in the detailed description of the present invention, specific details are set forth in order to provide a thorough understanding of the present invention. However, it will be obvious to one of ordinary skill in the art that the present invention may be practiced without these specific details. In other instances, well known methods, procedures, components, and circuits are not described in details to avoid unnecessarily obscuring a clear understanding of the present invention.

Figure 1:
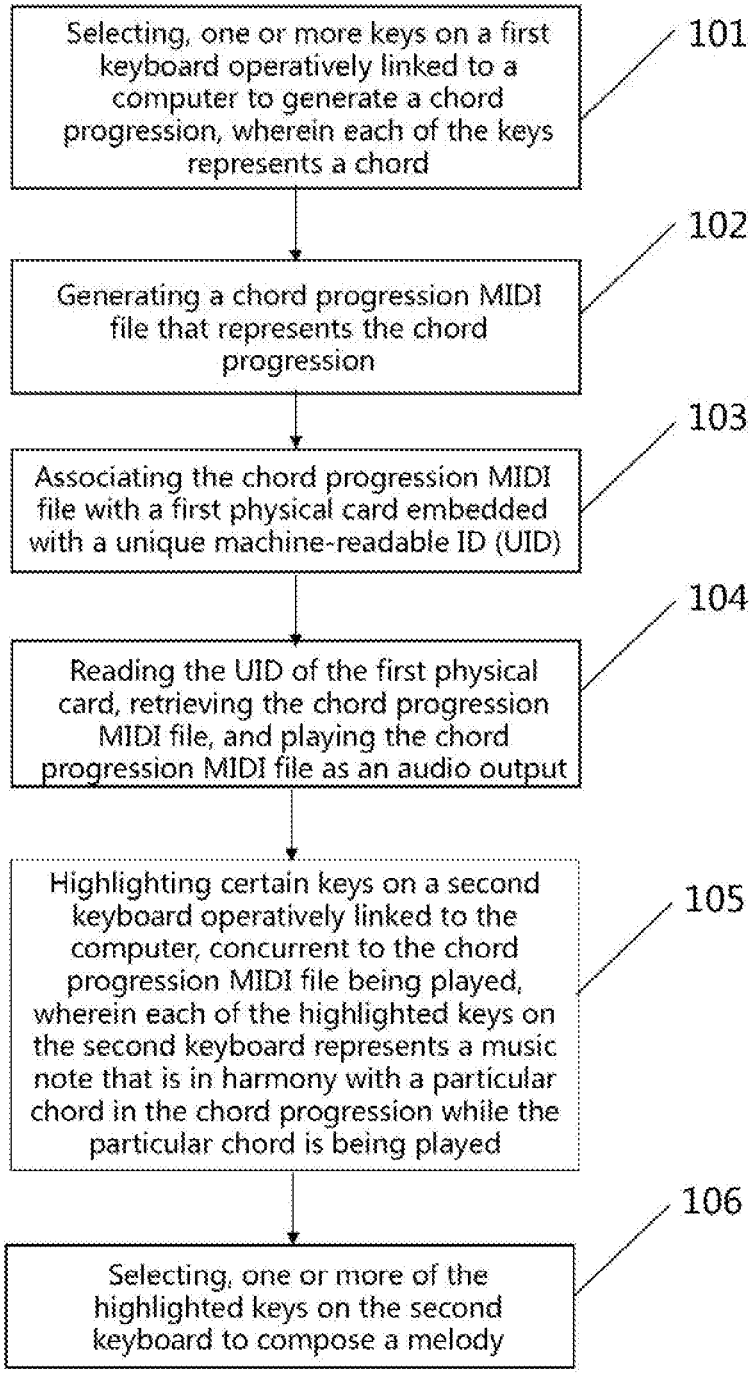
FIG. 1 is an exemplary schematic diagram illustrating the process flow for composing music with chord accompaniment in accordance with one embodiment of the present invention.

FIG. 1 is an exemplary schematic diagram illustrating the process flow for composing music with chord accompaniment in accordance with one embodiment of the present invention.

The process flow for the present invention has the following steps:

Step 101: selecting, by an end-user, one or more keys on a first keyboard operatively linked to a computer to generate a chord progression, wherein each of the keys represents a chord;

Step 102: generating, by the computer, a chord progression MIDI file that represents the chord progression;

Step 103: associating, by the end-user, the chord progression MIDI file with a first physical card among a plurality of physical cards, each embedded with a unique machine-readable ID (UID);

Step 104: reading the UID of the first physical card, retrieving the chord progression MIDI file, and playing the chord progression MIDI file as an audio output;

Step 105: highlighting, by the computer, certain keys on a second keyboard operatively linked to the computer, concurrent to the chord progression MIDI file being played by the computer, wherein each of the highlighted keys on the second keyboard represents a music note that is in harmony with a particular chord in the chord progression while the particular chord is being played;

Step 106: selecting, by the end user, one or more of the highlighted keys on the second keyboard to compose a melody.

Figure 2:
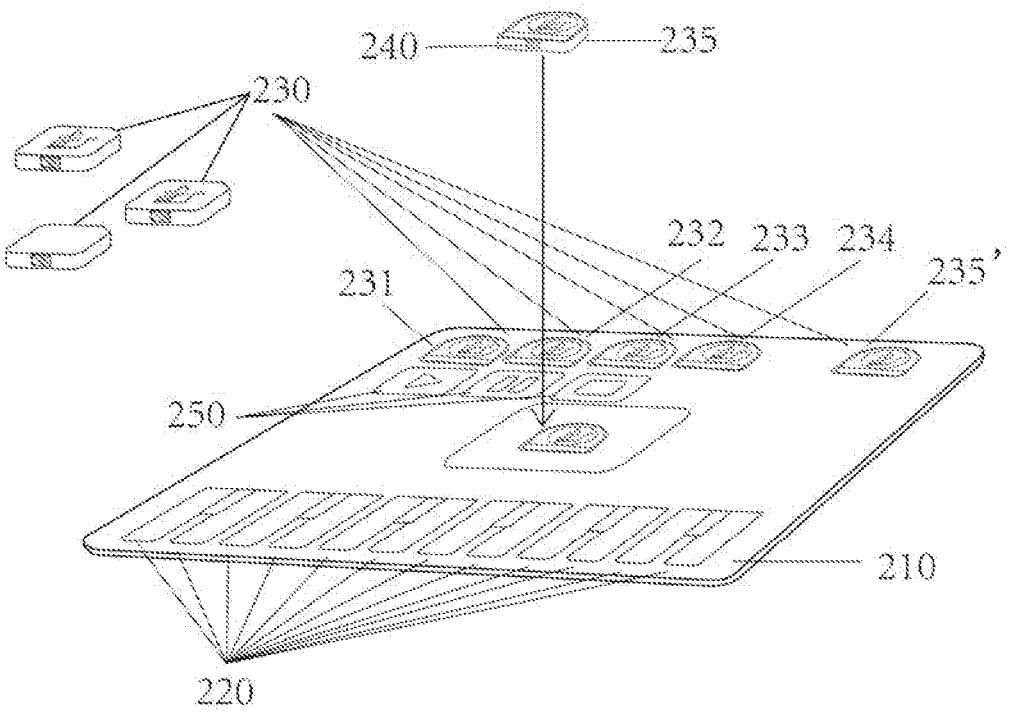
FIG. 2 is an exemplary schematic diagram illustrating a system process for generating a chord progression, including a keyboard and multiple chord cards, in accordance with one embodiment of the present invention.

FIG. 2 is an exemplary schematic diagram illustrating a system process for generating a chord progression, including a first keyboard and multiple chord cards, in accordance with one embodiment of the present invention.

In accordance with one embodiment of the present invention, as shown in FIG. 2, the system includes a first keyboard 210 and multiple chord cards 230. The keyboard 210 is operatively linked to a computer embedded in the keyboard 210 (not shown in FIG. 2), and has multiple keys 220, with each key 220 representing a chord. Each chord card 230 is embedded with a unique machine-readable ID (UID) 240, and visually marked with icons of music elements such as chord.

Figure 3:
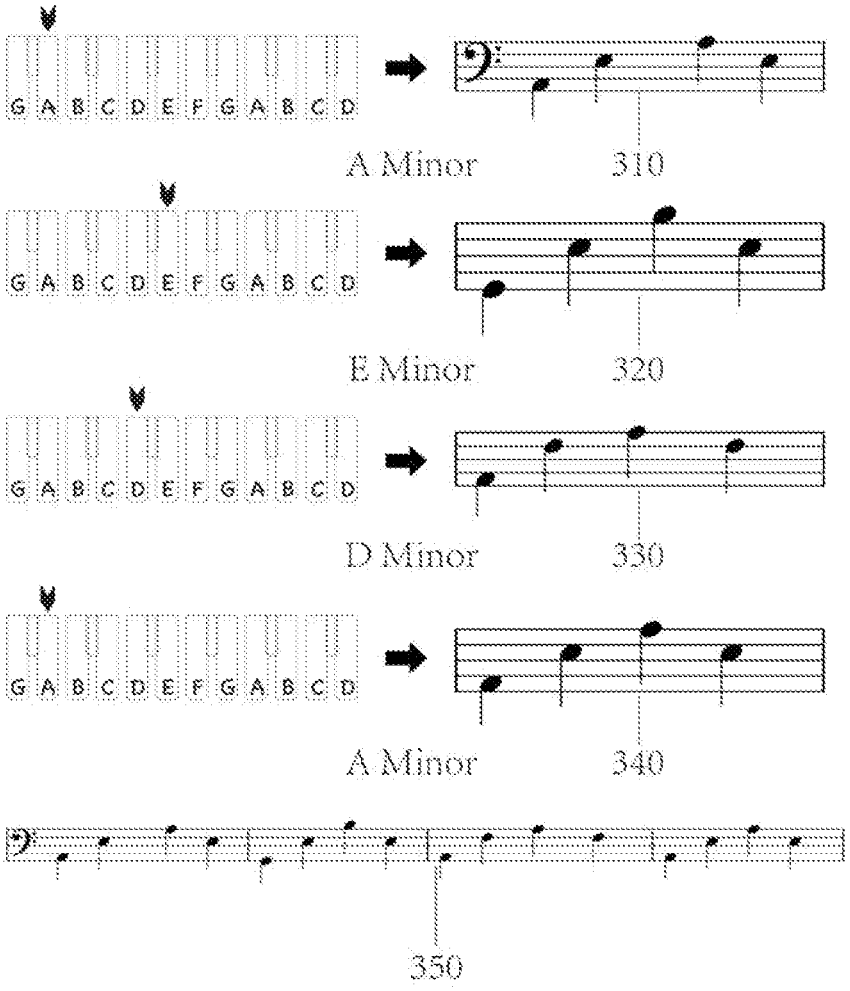
FIG. 3 is an exemplary schematic diagram illustrating the correspondence between selected keys and generated chords in accordance with one embodiment of the present invention.

When an end-user selects one or more keys 220, a chord progression is generated, based on the succession of chords represented by the keys 220 actually touched. For example, as shown in FIG. 3, when the end-user first selects a key A among the multiple keys 220, an A minor chord 310 (in the C major scale) for keyboard is generated. Similarly, if the end-user selects key E, key D and key A subsequently, an E minor chord 320, a D minor chord 330 and an A minor chord 340 will be generated. The four chords 310-340 comprise a chord progression 350, as shown in FIG. 3. A chord progression MIDI file that represents the chord progression 350 is then generated by the computer.

As shown in FIG. 2, this chord progression MIDI file is further associated with a particular chord card 235 among the multiple chord card 230 by the end-user. The chord progression MIDI file can be retrieved by the computer when the UID of this particular chord card 235 is read and recognized by a reader operatively linked to the computer and embedded in the keyboard 210 (not shown in FIG. 2). The chord progression MIDI file representing the chord progression 350 then may be played, paused or stopped by touching any of the buttons operatively linked to the computer and marked with the UI elements 250.

Alternatively, as seen in FIG. 2, each of the chords 310-340 can also be associated with a chord card 230, i.e., chords cards 231, 232, 233 and 234, when these chord cards are placed on the first keyboard 210. Specifically, the chord cards 231-234 are put together, e.g., next to each other laterally, in the sequence order of the chord cards 231-234 on the first keyboard 210, to generate a new chord card 235', which is also associated with the same progression MIDI file that represents the chord progression 350.

It should be noted that the computer and the reader may be both embedded in an interactive device without a screen, such as Beyond Tablet. According to this embodiment of the present invention, the first keyboard 210 could be a physical sheet placed on the interactive device, serving as a user interface and marked with icons of UI elements. Alternatively, the first keyboard 210 may include a screen, e.g., a touch-screen tablet or display or TV with RFID or NFC capability, equipped with the computer and the reader. According to this embodiment of the present invention, a key board is implemented as a user interface on the screen.

Figure 4:
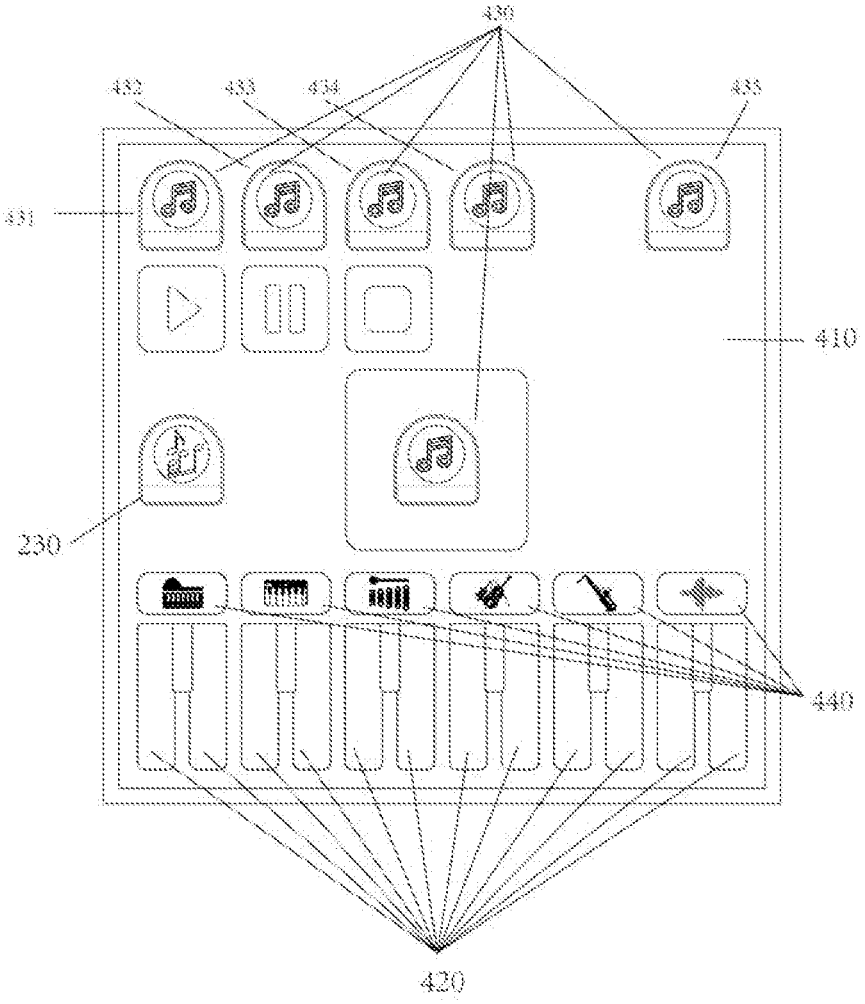
FIG. 4 is an exemplary schematic diagram illustrating a system process for composing a melody, further including a second keyboard and multiple melody cards, in accordance with one embodiment of the present invention.

In accordance with another embodiment of the present invention, as seen in FIG. 4, the system further includes a second keyboard 410 operatively linked to the computer and multiple melody cards 430. After a chord card 230 is placed on the second keyboard 410, the UID of this chord card 230 is read, and the chord progression MIDI file representing the chord progression is retrieved and played by the computer as an audio output. And while the chord progression MIDI is being played, certain keys 420 on the second keyboard 410 are highlighted by the computer. For example, when a particular chord in the chord progression 350, i.e., chord 310, 320, 330 or 340, is played, each of the highlighted keys 420 on the second keyboard 410 represents a music note that is in harmony with this particular chord.

Figure 5:
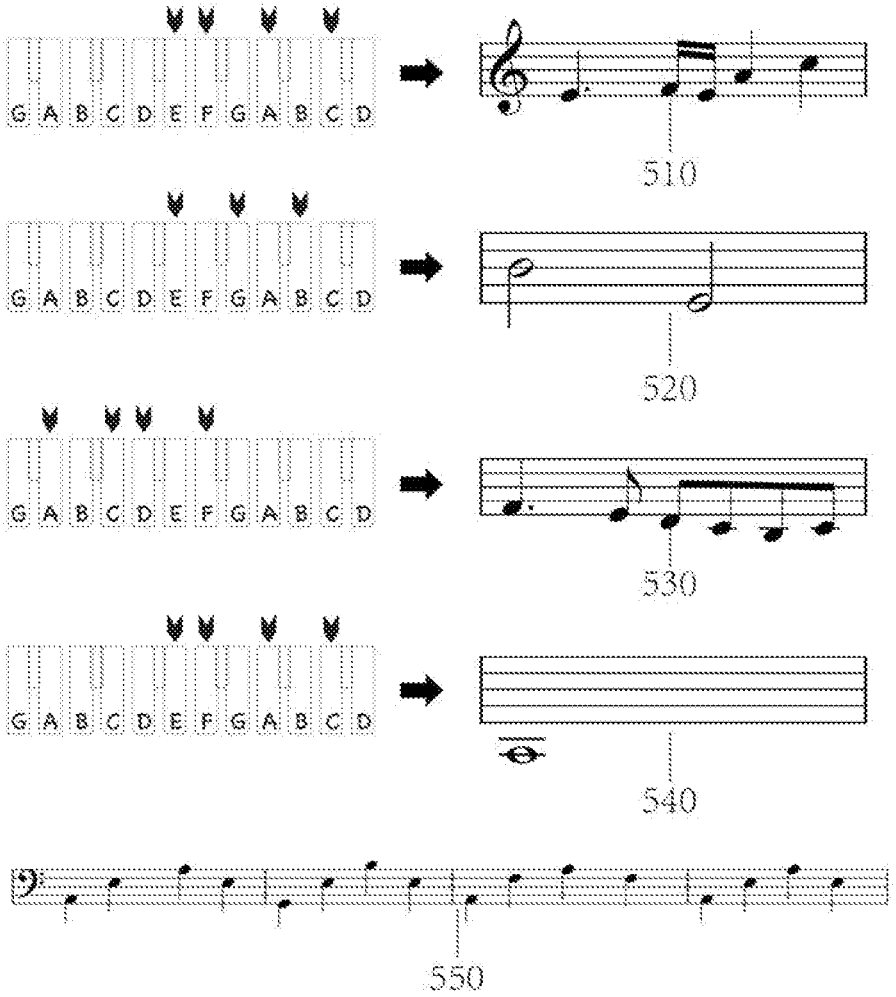
FIG. 5 is an exemplary schematic diagram illustrating the correspondence between highlighted keys and composed melodies in accordance with one embodiment of the present invention.

According to one embodiment of the present invention, a music note is in harmony with a chord, when the music note is one of the notes that comprise the chord, or when the music note is a full octave away from one of the notes that comprise the chord, or when the music note is a supplement, a variation, an enrichment, a decoration, or otherwise a contribution in harmony with the chord. For example, while the A minor chord 310 is being played, keys A, C and Eon the second keyboard 410 are highlighted to suggest end-users that melodies consisting of these would be in harmony with the A minor chord 310. In addition, key F is also highlighted, as a supplemental harmonious key of choice. As a result, a melody 510 containing the note sequence of E-F-E-A-C might be composed, as seen in FIG. 5. Similarly, while the E minor chord 320 is being played, keys E, G and B are highlighted, and the end-user may select notes B and E to compose a melody 520 that is in harmony with the chord 320. The melodies 530 and 540 are also composed in a similar manner.

It should be also noted that, although certain keys are highlighted as recommendation to end-users, the melody does not necessarily contain the recommended notes exclusively. Instead, with the recommended notes playing the major role in the composed melody, other notes of minor significance may also be used. For example, while the D minor chord 330 is being played, keys D, F and A on the second keyboard 410 are highlighted. In addition, key C is also highlighted as yet another key of recommendation for harmony considerations. The end-user may use some of the recommendations to compose an F-E-D-C-B-C melody 530 harmonized with the chord 330. However, notes E and B, which are not highlighted since they are no in harmony with D minor chord, are also found in the melody 530, to enrich the variations of the musical melody.

The four melodies 510-540 comprise a new melody 550, in parallel with the chord progression 350. A melody MIDI file that represents the melody 550 is then generated by the computer.

In accordance with another embodiment of the present invention, as seen in FIG. 4, a melody MIDI file that represents the melody created by the end-user is generated by the computer, and the melody MIDI file is associated with a melody card 430 that is embedded with a UID and readable by the computer. For instance, the melody MIDI file representing the melody 510 is associated with a melody card 431, the melody MIDI file representing the melody 520 is associated with a melody card 432, and so on, when the melody cards 431-434 are placed on the second keyboard 410. The use of the melody cards 430 enables the end-user to listen to and feel the differences among various melodies and pick the best one that satisfies the composer. For example, the timbre of the melody could be switched by touching the buttons 440, all operatively linked to the computer, marked with icons of music elements, i.e., various musical instruments. In addition, the length of the melodies can also be controlled at the end-user's will.

In accordance with another embodiment of the present invention, the multiple melody cards 430 can be put together, e.g., next to each other laterally, in the sequence order of the melody cards 431-434 on the second keyboard 410, to generate a new melody card 435, which is associated with a melody MIDI file that represents the melody 550 that combines all melodies 510-540.

Figure 6A:
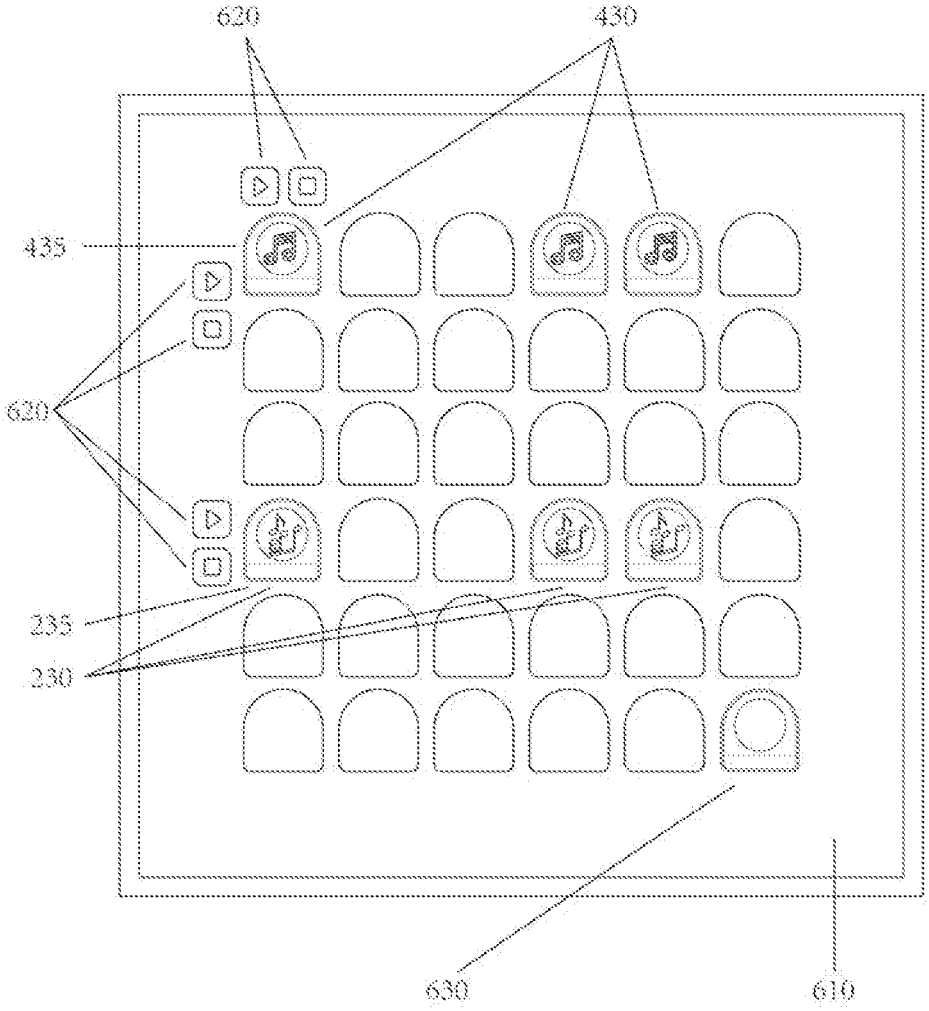
FIGS. 6*a* and 6*b* are exemplary schematic diagrams illustrating a system process for creating a music piece, including an interactive surface and a music piece card, in accordance with one embodiment of the present invention.
Figure 6B:
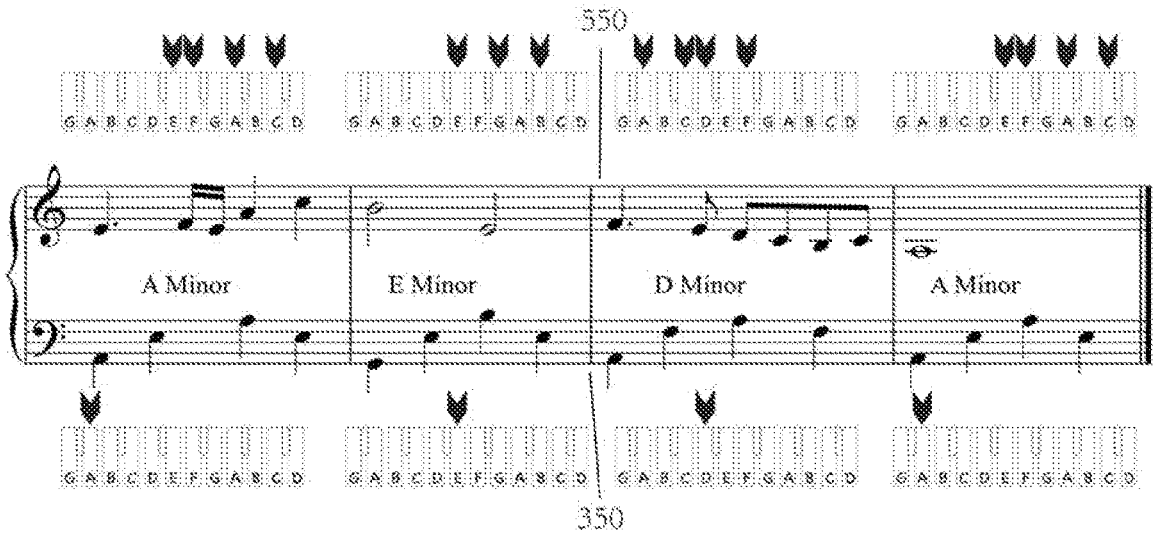

In accordance with another embodiment of the present invention, as seen in FIG. 6*a*, the chord progression MIDI file associated with the chord card 235 and the melody MIDI file associated with the melody card 435 are both retrieved and played simultaneously after both cards are placed on an interactive surface 610 and read by a reader embedded in the interactive surface 610 (not shown in FIG. 6). The two MIDI files are then combined into a new single MIDI file. Alternatively, the chord progression 350 and the melody 550 are played as a single music piece by the computer, as shown in FIG. 6*b*.

In accordance with another embodiment of the present invention, multiple chord cards 230 and/or multiple melody cards 430 can be placed together, which enables the MIDI files of the corresponding chord progressions and/or melodies to be played concurrently to generate more complicated music works. The new music piece generated can be played or stopped by pressing the buttons 620, and/or associated with a music piece card 630.

The invention claimed is:

1. A method for composing music with chord accompaniment, comprising:

selecting, by an end-user, one or more keys on a first keyboard operatively linked to a computer to generate a chord progression, wherein each of the keys represents a chord;

generating, by the computer, a chord progression MIDI file that represents the chord progression;

associating, by the end-user, the chord progression MIDI file with a first physical card among a plurality of physical cards, each embedded with a unique machine-readable ID (UID);

reading the UID of the first physical card, retrieving the chord progression MIDI file, and playing the chord progression MIDI file as an audio output;

highlighting, by the computer, certain keys on a second keyboard operatively linked to the computer, concurrent to the chord progression MIDI file being played by the computer, wherein each of the keys represents a music note;

wherein, each of the highlighted keys on the second keyboard represents a music note that is in harmony with a particular chord in the chord progression while the particular chord is being played; and selecting, by the end user, one or more of the highlighted keys on the second keyboard to compose a melody.

2. The method of claim 1, further comprising:

generating, by the computer, a melody MIDI file that represents the melody created by the end-user; and associating, by the end-user, the melody MIDI file with a second physical card.

3. The method of claim 2, further comprising:

placing, by the end-user, the first and the second physical cards on the reader;

retrieving, by the computer, the chord progression MIDI file associated with the first physical card and the melody MIDI file associated with the second physical cards; and combining the two MIDI files into a single MIDI file.

4. The method of claim 2, further comprising:

placing, by the end-user, the first and the second physical cards on the reader;

retrieving, by the computer, the chord progression MIDI file associated with the first physical card and the melody MIDI file associated with the second physical cards; and playing, by the computer, the chord progression and the melody as a single music piece.

5. A system for composing music with chord accompaniment, comprising:

a first keyboard operatively linked to a computer, with each of the keys representing a chord;

a first physical card among a plurality of physical cards, each embedded with a unique machine-readable ID (UID);

a reader that is operatively linked to the computer and detects the UID of a physical card;

a second keyboard operatively linked to the computer, with each of the keys representing a music note;

wherein, upon an end-user selecting one or more keys on the first keyboard to generate a chord progression, the computer is configured to generate a chord progression MIDI file that represents the chord progression; and wherein, the computer is further configured to associate the chord progression MIDI file with the UID of a first physical card, upon the end-user placing the first physical card on the reader; and wherein, subsequently, upon the first physical card placed on the reader, the computer is configured to retrieve the chord progression MIDI file associated with the first physical card, and play the chord progression MIDI file as an audio output; and wherein, concurrent to the chord progression MIDI file being played, the computer is configured to highlight certain keys on the second keyboard, with each of the highlighted keys represents a music note that is in harmony with a particular chord in the chord progression and while that particular chord is being played at the moment; and wherein, the end-user further selects one or more of the highlighted keys on the second keyboard to compose a melody.

6. The system of claim 5, wherein, the computer is configured to generate a melody MIDI file that represents the melody created by the end-user, and to associate the melody MIDI file with a second physical card.

7. The system of claim 6, wherein, upon the first and the second physical cards placed on the reader, the computer is configured to retrieve the chord progression MIDI file associated with the first physical card and the melody MIDI file associated with the second physical card, and combine the two MIDI files into a single MIDI file.

8. The system of claim 6, wherein, upon the first and the second physical cards are placed on the reader, the computer is configured to retrieve the chord progression MIDI file associated with the first physical card and the melody MIDI file associated with the second physical card, and play the chord progression and the melody as a single music piece.

* * * * *